US010589141B2

(12) United States Patent
Shimizu et al.

(10) Patent No.: US 10,589,141 B2
(45) Date of Patent: Mar. 17, 2020

(54) ACTIVE EXERCISE APPARATUS FOR LOWER LIMBS

(71) Applicants: University of Tsukuba, Tsukuba-shi (JP); Nemoto Seisakusho Co. Ltd., Kasama-shi (JP)

(72) Inventors: Yukiyo Shimizu, Tsukuba (JP); Masashi Yamazaki, Tsukuba (JP); Hiroshi Kamada, Tsukuba (JP); Kenta Tanaka, Tsukuba (JP); Toshiji Mizukoshi, Kasama (JP); Tsutomu Mizukoshi, Kasama (JP)

(73) Assignees: UNIVERSITY OF TSUKUBA, Ibaraki (JP); NEMOTO SEISAKUSHO CO. LTD., Ibaraki (JP)

( * ) Notice: Subject to any disclaimer, the term of this patent is extended or adjusted under 35 U.S.C. 154(b) by 73 days.

(21) Appl. No.: 15/439,325

(22) Filed: Feb. 22, 2017

(65) Prior Publication Data

US 2018/0207467 A1 Jul. 26, 2018

(30) Foreign Application Priority Data

Jan. 25, 2017 (JP) ..... 2017-010879

(51) Int. Cl.
*A63B 21/00* (2006.01)
*A63B 22/00* (2006.01)
(Continued)

(52) U.S. Cl.
CPC ..... *A63B 21/00178* (2013.01); *A61H 1/0266* (2013.01); *A63B 21/1672* (2015.10);
(Continued)

(58) Field of Classification Search
CPC .. A63B 21/4034; A63B 21/4011–4015; A63B 21/012–05; A63B 23/08–10; A61H 2209/00; A61H 1/0266
See application file for complete search history.

(56) References Cited

U.S. PATENT DOCUMENTS 1,502,947 A * 7/1924 Friesell ..... A61H 1/0266 606/241
2,427,761 A * 9/1947 Bull ..... A63B 22/16 482/80
(Continued)

FOREIGN PATENT DOCUMENTS

EP 2 206 536 A1 7/2010
JP 2008-302019 A 12/2008
(Continued)

*Primary Examiner* — Nyca T Nguyen
(74) *Attorney, Agent, or Firm* — Hauptman Ham, LLP

(57) ABSTRACT

The present invention is intended to provide an active exercise apparatus for lower limbs that allows a user to perform on a floor lower limb active exercise highly effective in preventing thrombosis. An active exercise apparatus for lower limbs 10 includes, for example, a base body 1; a shaft 2 fixed to the base body 1 such that a central axis is vertical to the surface of the base body 1; arms 3*a* and 3*b* that are rotatably attached to the shaft 2 and are extended in two directions at an equal angle with respect to the central axis of the shaft 2; sole support plates 4*a* and 4*b* that are attached to leading ends of the arms 3*a* and 3*b* and rotatable by rotation axes $x_1$ and $x_2$ parallel to the surface of the base body 1 and the rotation axes $z_1$ and $z_2$ vertical to the surface of the base body 1; and reaction force exertion members that are installed on the back surfaces of the sole support plates 4*a* and 4*b* to exert a reaction force on backward rotation by rotation axes $x_1$ and $x_2$ parallel to the surface of the base body 1.

16 Claims, 9 Drawing Sheets

(51) Int. Cl.

| | |
|---|---|
| ***A61H 1/02*** | (2006.01) |
| ***A63B 22/14*** | (2006.01) |
| ***A63B 21/16*** | (2006.01) |
| *A61H 7/00* | (2006.01) |

(52) U.S. Cl.

CPC ..... *A63B 21/4015* (2015.10); *A63B 21/4034* (2015.10); *A63B 21/4041* (2015.10); *A63B 22/0046* (2013.01); *A63B 22/0056* (2013.01); *A63B 22/14* (2013.01); *A61H 1/02* (2013.01); *A61H 1/024* (2013.01); *A61H 1/0237* (2013.01); *A61H 1/0244* (2013.01); *A61H 1/0255* (2013.01); *A61H 7/001* (2013.01); *A61H 2201/0142* (2013.01); *A61H 2201/0157* (2013.01); *A61H 2201/0192* (2013.01); *A61H 2201/1238* (2013.01); *A61H 2201/1409* (2013.01); *A61H 2201/164* (2013.01); *A61H 2201/1671* (2013.01); *A61H 2205/125* (2013.01); *A61H 2209/00* (2013.01); *A63B 21/4011* (2015.10); *A63B 21/4033* (2015.10); *A63B 2022/0097* (2013.01); *A63B 2208/0252* (2013.01)

(56) References Cited

U.S. PATENT DOCUMENTS

| | | | | | |
|---|---|---|---|---|---|
| 2,972,419 | A * | 2/1961 | Zelen | A47G 25/16 | 211/113 |
| 4,396,189 | A * | 8/1983 | Jenkins | A63B 69/18 | 434/253 |
| 4,973,046 | A * | 11/1990 | Maxwell | A63B 21/00178 | 482/60 |
| 5,038,758 | A * | 8/1991 | Iams | A61H 1/008 | 482/57 |
| 5,468,217 | A | 11/1995 | Garcia et al. | 601/32 | |
| 5,902,218 | A * | 5/1999 | Froelich, Sr. | A63B 21/4035 | 482/118 |
| 9,375,600 | B2 * | 6/2016 | Liu | A63B 22/16 | |
| 2003/0060339 | A1 * | 3/2003 | Ravikumar | A61H 1/0266 | 482/80 |
| 2017/0014666 | A1 * | 1/2017 | Sather | A63B 23/0205 | |

FOREIGN PATENT DOCUMENTS

| | | | |
|---|---|---|---|
| JP | 2012-29787 | A | 2/2012 |
| JP | 2013-34755 | A | 2/2013 |
| JP | 2016-165365 | A | 9/2016 |
| WO | WO 00/54848 | A1 | 9/2000 |

* cited by examiner

ACTIVE EXERCISE APPARATUS FOR LOWER LIMBS

CROSS-REFERENCE TO RELATED APPLICATIONS

This application claims the benefit of priority to Japanese Application No. 2017-010879, filed Jan. 25, 2017, in the Japanese Patent Office. All disclosures of the document named above are incorporated herein in their entireties by reference.

FIELD OF THE INVENTION

The present invention relates to an active exercise apparatus for a patient or the like to move their lower limbs by themselves, and more specifically, relates to an apparatus for performing active exercise of lower limbs on a floor.

DESCRIPTION OF THE RELATED ART

We have entered into the super-aged society, and osteoarthritis is largely exerting influence on elderly people's healthy life span and is increasing the possibility of bringing them into the state in need of nursing care. As one of countermeasures against this issue, total joint arthroplasty of lower limb is expected to improve significantly the quality of life (QOL), but poses a high risk of deep vein thrombosis (DVT) after surgery.

Deep vein thrombosis (DVT) and subsequent pulmonary embolism (PE) are severe complications in surgery. In addition, the incidence of DVT and PE become higher in environments where the patients' activities are limited due to evacuation from disasters or the like, and therefore preventative measures are required.

Under the current DVT prevention guidelines, pharmacological prevention methods using anticoagulant or the like and physical prevention methods such as early ambulation, wearing elastic stockings, intermittent pneumatic compression devices, and lower limb active exercise are recommended. Among them, the method of increasing blood flow to the leg vein by active exercise is particularly regarded as being effective in the prevention of DVT and PE.

There have been conventionally proposed apparatuses for moving passively or actively ankle joints to increase blood flow to the leg vein (refer to Patent Documents 1 to 3, for example). The apparatuses described in Patent Documents 1 and 2 are configured to assist the dorsal flexion and extension of a user's ankle joints by operating sole holding plates with a drive source such as a motor. The apparatus described in Patent Document 3 is an apparatus for a patient to perform active exercise by themselves and is configured such that right and left holders holding the patient's feet are capable of turning in the horizontal direction and are moved in synchronization in the front-back direction.

There has also been proposed a preventive instrument including sole fixing parts, a wearing part having a belt body wound around and fixed to a user's lower legs, and an elastic part composed of an elastic material to connect the sole fixing parts and the wearing part to exert a biasing force against the rotation of the ankle joints (see Patent Document 4). When the user wearing the preventive instrument performs the plantar flexion motion of the ankle joints, the belt body compresses the sural region to increase the rate of blood flow in the deep veins of the lower legs, and the elastic part applies a load to the plantar flexion motion of the ankle joints, thereby enhancing the motion effect.

CITATION LIST

Patent Documents

Patent Literature 1: Japanese Unexamined Patent Application Publication No. 2008-302019

Patent Literature 2: Japanese Unexamined Patent Application Publication No. 2012-29787

Patent Literature 3: Japanese Unexamined Patent Application Publication No. 2013-34755

Patent Literature 4: Japanese Unexamined Patent Application Publication No. 2016-165365

SUMMARY OF THE INVENTION

However, the foregoing conventional instruments for lower limb exercise have such problems as described below. Although it is known that performing exercise to contract and relax soleus muscles would decrease the incidence of thrombosis, the apparatuses described in Patent Documents 1 and 2 are intended to move only the ankle joints while fixing the ankles and shins. The calf muscles and the soleus muscles work on the plantar flexion of the ankle joints. The soleus muscles are site of predilection for thrombosis and are desirably caused to contract. However, when the ankle joints are plantarflexed in a knee extension position, the calf muscles become agonist muscles and thus the soleus muscles may not be sufficiently contracted.

In addition, the apparatuses described in Patent Documents 1 and 2 need a drive source such as a motor, and are larger in size and weight with poor handling properties. Further, these apparatuses are designed for passive exercise and are lower in the effect of preventing DVT as compared to active exercise.

Meanwhile, the apparatus described in Patent Document 3 is designed for patients to move their lower limbs by themselves and perform active exercise, and is expected to be highly effective in preventing DVT. However, the apparatus cannot be said to produce the sufficient contraction of the soleus muscles and is needed to further improve exercise efficiency. The apparatus described in Patent Document 3 is also heavy in weight and is not easy to attach to a bed or the like and adjust the position of the apparatus. Further, the preventive instrument described in Patent Document 4 is not suited for use on a floor and takes a lot of trouble in wearing, and is difficult to apply to the patients immediately after total joint arthroplasty.

Accordingly, an object of the present invention is to provide an active exercise apparatus for lower limbs that allows the user to perform on a floor lower limb active exercise highly effective in preventing thrombosis.

An active exercise apparatus for lower limbs according to the present invention includes at least: a base body; a shaft fixed to the base body such that a central axis is vertical to a surface of the base body; arms that are rotatably attached to the shaft and are extended in two directions at an equal angle with respect to the central axis of the shaft; sole support plates that are attached to leading ends of the arms and rotatable by rotation axes parallel to the surface of the base body; and reaction force exertion members that are installed on back surfaces of the sole support plates to exert a reaction force on backward rotation by the rotation axes parallel to the surface of the base body.

In the active exercise apparatus for lower limbs according to the present invention, the sole support plates supporting a right foot or a left foot may be attached to the leading ends of the arms and rotatable by the rotation axes parallel to the surface of the base body and the rotation axes vertical to the surface of the base body, and the reaction force exertion members may be installed on the back surfaces of the sole support plates.

The sole support plates can be disposed above the base body.

The active exercise apparatus of the present invention may include a mountain-shaped stage that is inclined downward from a center in a front-back direction and has the center positioned on the backs of a user's knees to hold the user's lower limbs with the knees in flexion.

In addition, holding fixtures for holding the user's feet may be attached to the sole support plates. In that case, the holding fixtures may include sole venous plexus compression members.

The active exercise apparatus of the present invention may include hook members for mounting on a fence of a bed.

The active exercise apparatus of the present invention may also include adjustment mechanisms to adjust the positions of the sole support plates in the front-back direction and the vertical direction.

The active exercise here means the ankle joints' dorsal flexion, plantar flexion, inversion, eversion, or composite exercise of two or more of the foregoing motions, for example.

According to the present invention, it is possible to allow the user to perform active exercise highly effective in venous return promotion on a floor and prevent the onset of thrombosis in an efficient way.

DESCRIPTION OF EMBODIMENTS

Embodiments for carrying out the present invention will be described below in detail with reference to the accompanying drawings. The present invention is not limited to the embodiments described below.

First Embodiment

Figure 1:
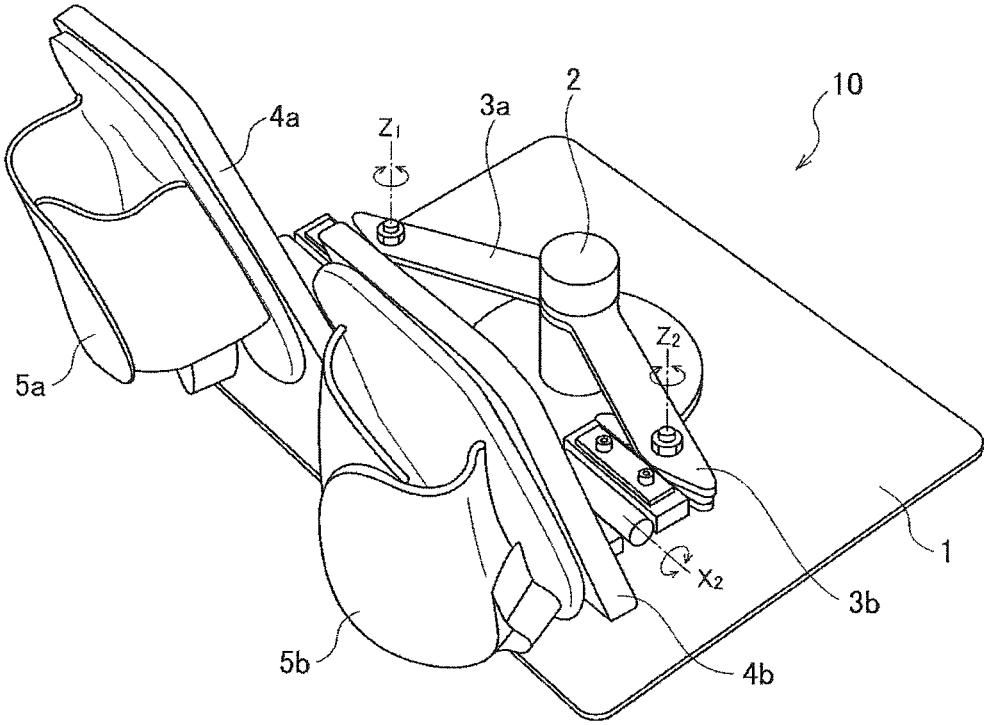
FIG. 1 is a schematic perspective view of a configuration of an active exercise apparatus according to a first embodiment of the present invention.
Figure 2:
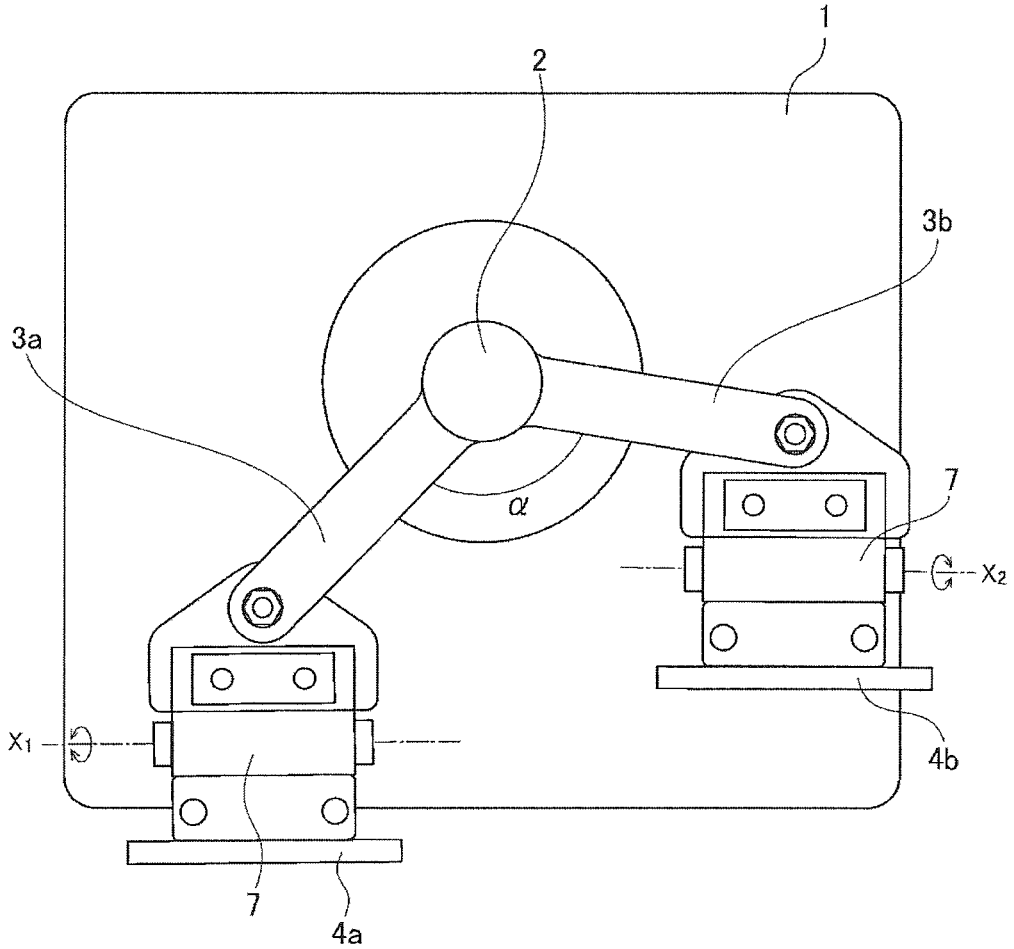
FIG. 2 is a plan view of an active exercise apparatus 10 illustrated in FIG. 1.

First, an active exercise apparatus according to a first embodiment of the present invention will be described. FIG. 1 is a perspective view of a configuration of the active exercise apparatus according to the first embodiment of the present invention, and FIG. 2 is a plan view of the same. The active exercise apparatus of the embodiment is intended to assist a user such as a patient in performing lower limb active exercise by moving their lower limbs. As illustrated in FIGS. 1 and 2, a shaft 2 is fixed to a base body 1, arms 3*a* and 3*b* extending in two directions are rotatably attached to the shaft 2, and sole support plates 4*a* and 4*b* are attached to the leading ends of the arms 3*a* and 3*b*. The foregoing members can be formed from metallic materials, for example.

[Base Body 1]

The base body 1 is a flat plate-like member, for example, and there is no particular limitation on its size and thickness. However, the base body 1 is desirably sized to support reliably the members such as the shaft 2, the arms 3*a* and 3*b*, and the sole support plates 4*a* and 4*b* and to be easily installed into or removed from a bed or the like.

[Shaft 2]

The shaft 2 is arranged with a central axis approximately vertical to the surface of the base body 1 and is fixed to the base body 1 by a fixing member such as a bolt. There is no particular limitation on the material and thickness of the shaft 2 as far as it is strong enough to support the arms 3*a* and 3*b*, the sole support plate 4*a* and 4*b*, and holding fixtures 5*a* and 5*b* and withstand a load at the time of use.

[Arms 3*a* and 3*b*]

The arm 3*a* and the arm 3*b* may be formed integrally or separately as far as they are equal in angle with respect to the central axis of the shaft 2. When the arms 3*a* and 3*b* are integrally formed, the center is attached to the shaft 2, and the sole support plates 4*a* and 4*b* are attached to the both ends. When the arms 3*a* and 3*b* are separately formed, first ends of the arms 3*a* and 3*b* are attached to the shaft 2, and the sole support plates 4*a* and 4*b* are attached to second ends of the arms 3*a* and 3*b*. In that case, the arms 3*a* and 3*b* may rotate around the shaft 2 in the horizontal direction independently from each other or in synchronization with each other.

In addition, the arms 3*a* and 3*b* may be capable of rotating around the shaft 2 in the horizontal direction at an inner angle $\alpha$ kept constant, for example. As illustrated in FIG. 2, the term "inner angle $\alpha$" here refers to the smaller one of angles formed by the arm 3*a* and the arm 3*b*. The inner angle $\alpha$ can be set as appropriate depending on the user's body shape and condition, but is preferably 130 to 150°. By setting the positions of the arm 3*a* and the arm 3*b* at the inner angle $\alpha$ within this range and holding the angle during the rotational movement, the user can perform exercise in a decubitus position to contract efficiently the soleus muscles without a load on the both lower limbs. As a result, the user can perform lower limb active exercise more higher effective in preventing thrombosis than in the case of using the conventional apparatuses.

[Sole Support Plates 4*a* and 4*b*]

The sole support plate 4*a* is attached to the leading end of the arm 3*a* and the sole support plate 4*b* is attached to the leading end of the arm 3*b*. These sole support plates 4*a* and 4*b* are preferably mounted in positions higher than the upper surface of the base body 1 so that the positions of the user's feet are higher than the heart while using the apparatus on a floor. This enhances the effect of contracting the soleus muscles and increases the blood flow rate of the leg vein. The height of the sole support plates 4*a* and 4*b* can be set as appropriate depending on the user's body shape and condition, but is preferably 5 to 10 cm from the floor surface from the viewpoint of promoting blood flow.

In addition, the sole support plates 4*a* and 4*b* are rotatable at arbitrary angles with respect to axes $x_1$ and $x_2$ parallel to the surface of the base body 1 and with respect to axes $z_1$ and $z_2$ vertical to the surface of the base body 1. By three rotational motions, that is, the rotation around the shaft 2 as a central axis described above, the rotation around the axes $x_1$ and $x_2$ as central axes, and the rotation around the axes $z_1$ and $z_2$ as central axes, the sole support plates 4*a* and 4*b* allow the user to perform the dorsal flexion, plantar flexion, inversion, or eversion of the ankle joints or composite exercise of two or more of the foregoing motions.

Figure 3A:
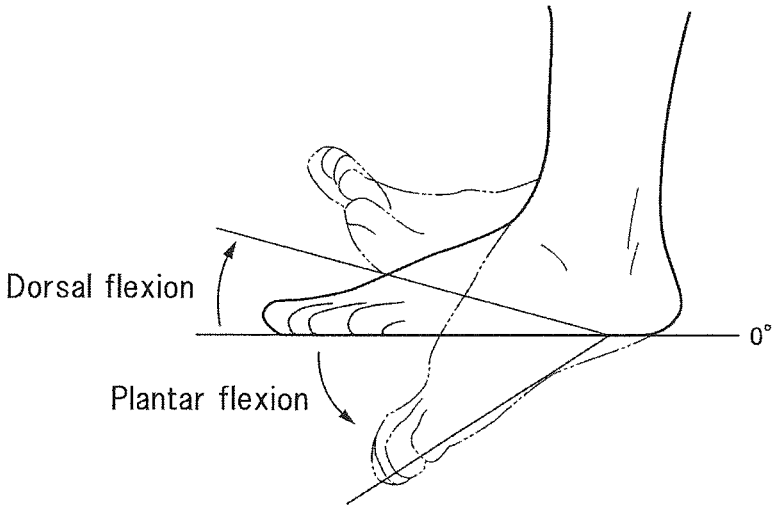
FIGS. 3A and 3B are conceptual diagrams of motions of an ankle joint.
Figure 3B:
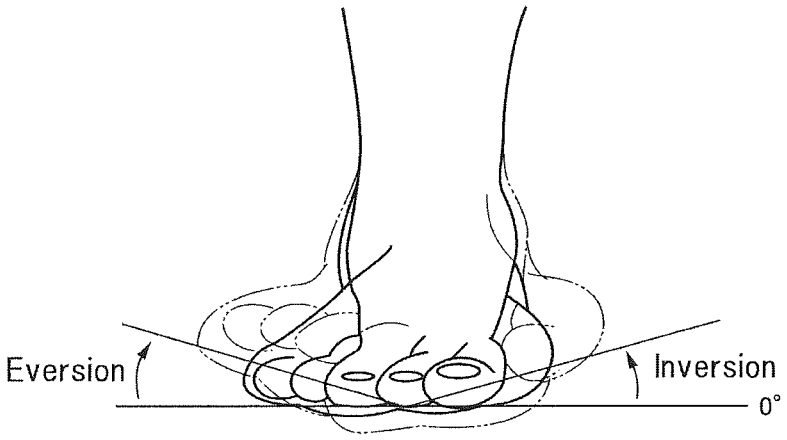

FIGS. 3A and 3B are conceptual diagrams of motions of an ankle joint. In general, a healthy person's ankle joint has motion ranges of 20° in dorsal flexion, 45° in plantar flexion, 20° in inversion, and 20° in eversion. Accordingly, in an active exercise apparatus 10 of the embodiment, when the positions of the surfaces of the sole support plates 4*a* and 4*b* vertical to the surface of the base body 1 are designated as 0°, the rotation angles (motion ranges) of the sole support plates 4*a* and 4*b* are preferably 20 to 30° on the dorsal flexion side illustrated in FIG. 3A (mainly, the forward rotation around the axis $x_1$), 50 to 60° on the plantar flexion side illustrated in FIG. 3A (mainly the backward rotation around the axis $x_1$), 20 to 30° on the inversion side illustrated in FIG. 3B (mainly the inward rotation around the axis $z_1$), and 10 to 20° on the eversion side illustrated in FIG. 3B (mainly the outward rotation around the axis $z_1$). This allows healthy persons as well to perform efficient active exercise.

In the active exercise apparatus 10 illustrated in FIG. 2, the term "forward rotation around the axis $x_1$" refers to the rotation toward the user, that is, toward the lower side of the drawing, the term "backward rotation around the axis $x_1$" refers to the rotation toward the upper side of the drawing. The term "inward rotation around the axis $z_1$" refers to the rotation toward the right side of the drawing for the sole support plate 4*a*, and refers to the rotation toward the left side of the drawing for the support plate 4*b*. In reverse, the term "outward rotation around the axis $z_1$" refers to the rotation toward the left side of the drawing for the sole support plate 4*a*, and refers to the rotation toward the right side of the drawing for the support plate 4*b*.

[Reaction Force Exertion Member 7]

In the active exercise apparatus 10 of the embodiment, reaction force exertion members 7 are mounted on the back surfaces of the sole support plates 4*a* and 4*b* to exert a reaction force to the backward rotation of the sole support plates 4*a* and 4*b* around the axes $x_1$ and $x_2$ parallel to the surface of the base body 1, that is, the plantar flexion motion. Meanwhile, the reaction force exertion members 7 have the force of forward rotation of the sole support plates 4*a* and 4*b* around the axes $x_1$ and $x_2$ parallel to the surface of the base body 1 to reduce a load on dorsal flexion motion.

In general, the soleus muscles or the calf muscles contract in the plantar flexion motion, and the anterior tibial muscles contract in the dorsal flexion motion. Therefore, if the user performs the active exercise such as the dorsal flexion and the plantar flexion without application or reduction of a load by the reaction force exertion members 7, the smaller anterior tibial muscles become fatigued earlier than the soleus muscles and the calf muscles, which may inhibit continuance of the active exercise. In contrast, in the active exercise apparatus 10 of the embodiment, the reaction force exertion members 7 reduce the load of the dorsal flexion motion and apply the load of the plantar flexion motion to improve the efficiency of the lower limb active exercise and contract effectively the soleus muscles.

The reaction force exertion members 7 used in the active exercise apparatus 10 may be springs, oil hydraulic cylinders, pneumatic cylinders, or the like. However, springs are preferable from the viewpoints of size reduction of the apparatus and ease of adjusting the magnitude of the reaction force. The magnitude of the reaction force exerted by the reaction force exertion members 7 can be set as appropriate depending on the user's body shape and condition. However, from the viewpoints of improving exercise efficiency and preventing overload on the lower limbs, the load applied to the moment length (about 20 cm) of the sole support plates 4*a* and 4*b* is preferably set to a range of from 0.98 N (100 gf) to the user's body weight, that is, the load torque is preferably set to a range from 0.2 Nm to 2×the user's body weight (kg) Nm.

The reaction force exertion members 7 are preferably provided with reaction force adjustment mechanisms capable of adjusting the magnitude of the reaction force depending on the individual user or the user's condition in each day. In addition, in the active exercise apparatus 10 of the embodiment, the reaction force exertion members 7 are provided on the back surfaces of the sole support plates 4*a* and 4*b*, and therefore, in the initial state before exercise, the angle formed by the sole support plates 4*a* and 4*b* and the surface of the base body 1 is 90° or less.

[Holding Fixtures 5*a* and 5*b*]

Figure 4:
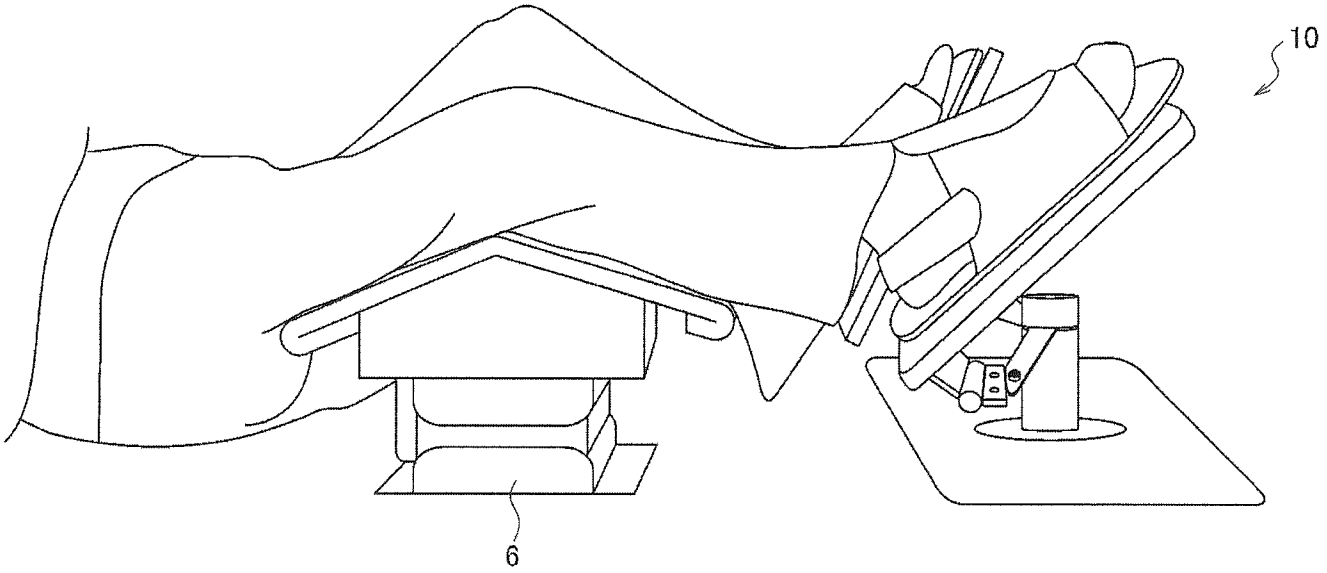
FIG. 4 is a schematic diagram illustrating a usage example of the active exercise apparatus 10 illustrated in FIG. 1.
Figure 5:
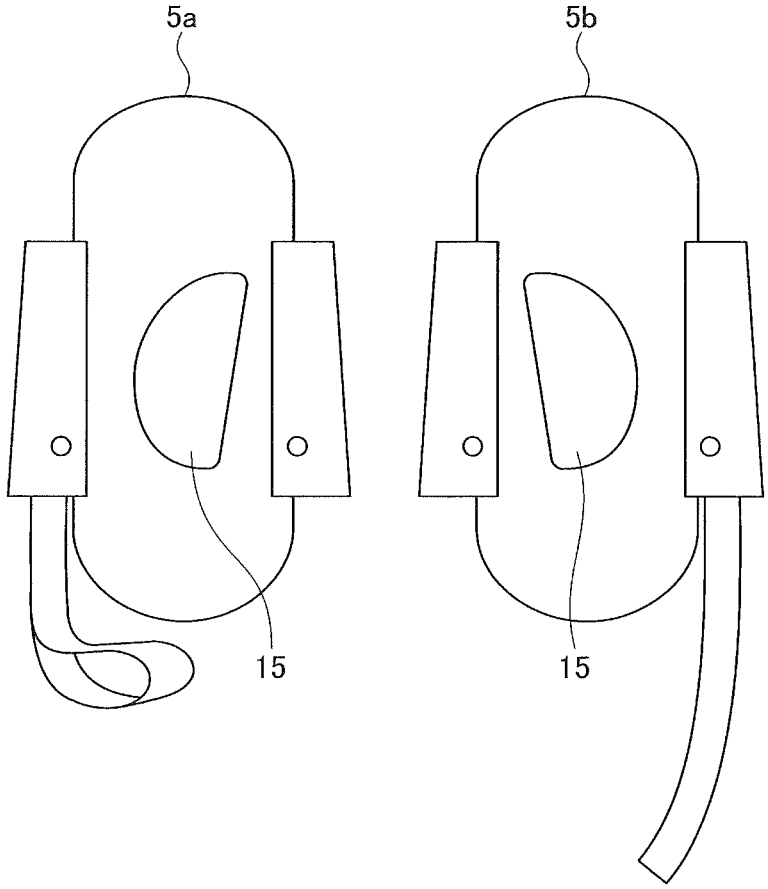
FIG. 5 is a schematic view of an example of holding fixtures 5*a* and 5*b;*

In the active exercise apparatus 10 of the embodiment, holding fixtures can be attached as necessary to the sole support plates 4*a* and 4*b* to hold the user's feet. The "feet" here refers to ankles and lower parts. FIG. 4 is a schematic diagram illustrating a usage example of the active exercise apparatus 10 illustrated in FIG. 1, and FIG. 5 is a schematic view of a configuration example of holding fixtures 5*a* and 5*b*. As illustrated in FIG. 4, the holding fixtures 5*a* and 5*b* are structured to hold the user's soles, insteps, and heels, for example, and be detachable from the sole support plates 4*a* and 4*b*.

There is no particular limitation on the material of the holding fixtures 5*a* and 5*b*, but woven fabric, non-woven fabric, synthetic resin, leather, or the like can be used for the holding fixtures 5*a* and 5*b*. The holding fixtures 5*a* and 5*b* are preferably made from leather for its fit. In addition, there is no particular limitation on the method of attaching the holding fixtures 5*a* and 5*b* to the sole support plates 4*a* and 4*b*. However, the holding fixtures 5*a* and 5*b* are desirably fixed in a firm manner to the sole support plates 4*a* and 4*b* by screws or the like such that they do not get displaced or come off during use.

In addition, as illustrated in FIG. 5, members for compressing the plantar venous plexus may be provided on the surfaces of the holding fixtures 5*a* and 5*b* contacting the soles. The plantar venous plexus compression members 15 may be formed from a low rebound material such as a low rebound elastic foam, for example. Providing the plantar venous plexus compression members 15 enhances the effect of improving blood flow by low limb active exercise. The positions and size of the plantar venous plexus compression members 15 can be set as appropriate according to the user.

[Stage 6]

As illustrated in FIG. 4, the active exercise apparatus 10 of the embodiment is used by the user to perform exercise with the knees in flexion while setting the soles on the sole support plates 4*a* and 4*b* or holding the feet by the holding fixtures 5*a* and 5*b*. At that time, the user may hold the back sides of the knees with a mountain-shaped stage 6 inclined downward from the center in the front-back direction. This makes it possible to hold the affected limbs after surgery and attach the holding fixtures 5*a* and 5*b* at appropriately set joint angles.

[Other Members]

In addition to the foregoing members, the active exercise apparatus 10 of the embodiment may have a counter (not illustrated) for counting the number of times when exercise was performed. There is no particular limitation on the method of measuring by the counter the number of times when exercise was performed. For example, magnetic sensors may be mounted in the sole support plates 4*a* and 4*b* to count one when the user can make a stepping motion at an arbitrary plantar flexion angle.

[Operations]

Next, the operations of the active exercise apparatus 10 of the embodiment will be described. To perform active exercise using the active exercise apparatus 10 of the embodiment, for example, the base body 1 is installed on the bottom surface of a bed or the like, and the user in a decubitus position with the knees in flexion at an angle of 20 to 50° sets the right and left soles on the sole support plates 4*a* and 4*b* or holds the right and left feet by the holding fixtures 5*a* and 5*b*. When the user performs plantar flexion motion with the knees in flexion (in a knee flexion position), the activity of the calf muscles decreases and the activity of the soleus muscles increases relatively. Accordingly, the user can perform active exercise highly effective in promoting venous return on the floor.

Next, the user moves the right foot and the left foot by themselves. For example, when the user stretches the right foot, the sole support plate 4*b* rotates around the shaft 2, the axis x2, and the axis z2 as central axes, and the right foot makes a plantar flexion motion as illustrated in FIG. 3A. At that time, the arm 3*a* and 3*b* rotate leftward around the shaft 2 as a central axis, and the sole support plate 4*a* moves toward the user, and the left foot makes a dorsal flexion motion. In reverse, when the user stretches the left foot, the left foot makes a plantar flexion motion and the right foot makes a dorsal flexion motion. Accordingly, the user can perform not only ankle joint exercise but also the flexion and extension of the knees and the flexion and extension of the hip joints.

In addition, the active exercise apparatus 10 of the embodiment is rotatable at predetermined angles with respect to the axes $z_1$ and $z_2$ vertical to the surface of the base body 1, and allows the inversion and eversion of the ankle joints as well. At that time, the user can also make internal rotational motion and external rotational motion of the hip joints. Further, the active exercise apparatus 10 of the embodiment allows the three rotational motions, that is, the rotation around the shaft 2, the rotation around the axes $x_1$ and $x_2$, and the rotation around the axes $z_1$ and $z_2$ as described above. Accordingly, the user can perform composite exercise of the entire lower limbs including the dorsal flexion, plantar flexion, inversion, and eversion of the ankle joints, the flexion and extension of the knees, and the flexion, extension, internal rotation, and external rotation of the hip joints.

As described above in detail, the active exercise apparatus of the embodiment is configured such that the right and left sole support plates rotate around the shaft and the central axes parallel to the surface of the base body, and rotate around the central axes vertical to the surface of the base body, thereby allowing the user to perform actively the dorsal flexion, plantar flexion, inversion, or eversion of the ankle joints or composite exercise of two or more of the foregoing motions. In particular, the composite exercise in which inversion and eversion are added to the dorsal flexion and plantar flexion motion of the ankle joints is known to be more highly effective in improving lower limb blood flow than in the case of performing singly the plantar flexion and the dorsal flexion motion (for example, refer to D. H. Sochart, K. Hardinge, "The relationship of foot and ankle movements to venous return in the lower limb", THE JOURNAL OF BONE AND JOINT SURGERY, July 1999, VOL. 81-B, NO. 4, pp. 700 to 704). Accordingly, it can be expected that, by performing active exercise using the apparatus of the embodiment, even a patient immediately after total joint arthroplasty can prevent thrombosis in a highly effective manner.

The conventional apparatuses described above are configured such that the user performs only ankle joint exercise such as the planar and dorsal flexions, inversion, and eversion of the ankle joints while fixing the body parts above the ankles such as the knees. In contrast, with the active exercise apparatus of the embodiment, the user is in a foot raising position and a knee flexion position. Therefore, the user can perform active lower limb composite exercise such as the flexion and extension of the knees, and the flexion, extension, internal rotation, and external rotation of the hip joints in addition to the compound exercise of the ankles. There has not been conventionally any apparatus that allows composite exercise of the entire lower limbs in a recumbent position on a floor. The mechanism of the apparatus of the present invention has been uniquely devised on the basis of the inventor's research.

The active exercise apparatus of the embodiment includes the reaction force exertion members such as springs on the sole support plates to reduce a load in the dorsal flexion direction, and in reverse, apply a load when the sole support plates are pressed down in the plantar flexion direction. Accordingly, it is possible to overcome the problem with the publicly known techniques for interruption of active exercise due to earlier fatigue of the anterior tibial muscles used for dorsal flexion, thereby improving the exercise efficiency and contracting the soleus muscles in a more effective way. As a result, by using the active exercise apparatus of the embodiment, the user can perform on a floor active exercise highly effective in promoting venous return and prevent efficiently the onset of thrombosis and maintain muscle mass.

Further, in the active exercise apparatus of the embodiment, attaching the holding fixtures to the sole support plates and providing the plantar venous plexus compression members to the holding fixtures, it is also possible to further enhance the effect of increasing the blood flow rate by the lower limb active exercise.

Second Embodiment

Figure 6:
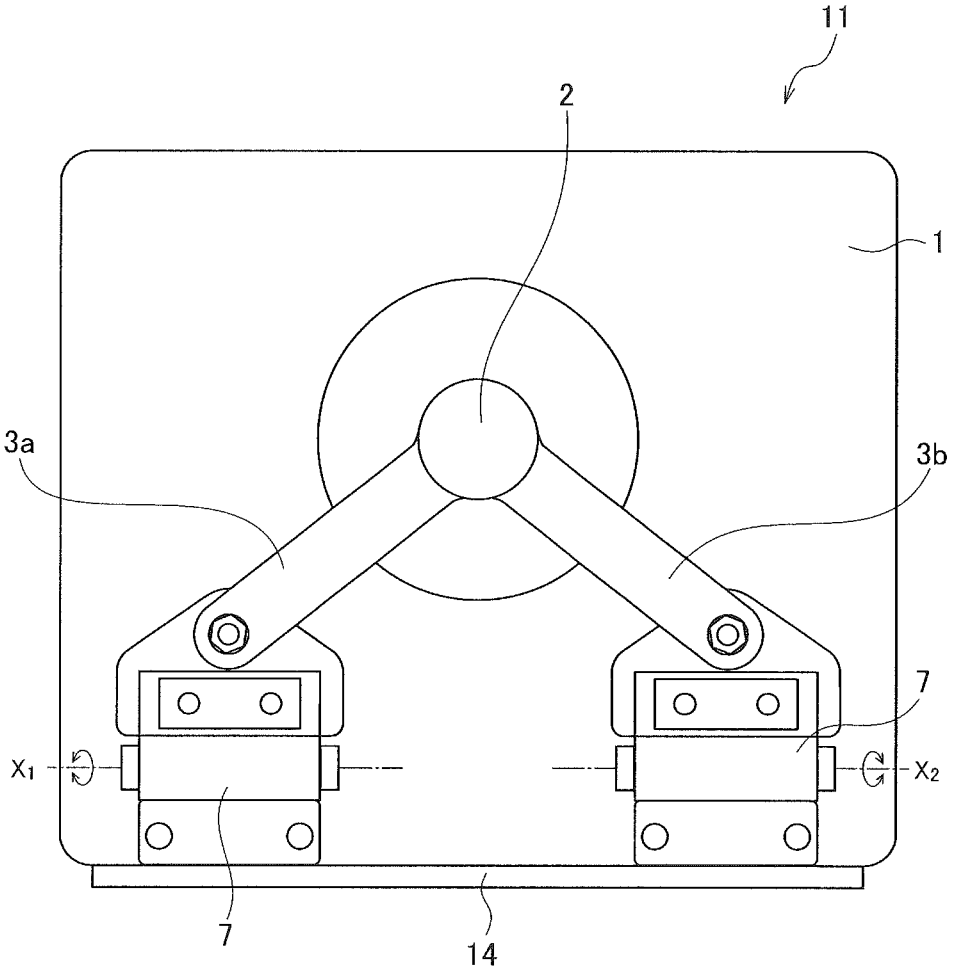
FIG. 6 is a schematic plan view of a configuration of an active exercise apparatus according to a second embodiment of the present invention.

Next, an active exercise apparatus according to a second embodiment of the present invention will be described. The first embodiment described above is configured to include two sole support stages for the right and left legs as an example. However, the present invention is not limited to this but may be configured to allow the user to perform exercise while supporting the both right and left legs by one sole support plate. FIG. 6 is a plan view of a configuration of an active exercise apparatus according to the embodiment. In FIG. 6, the same components as those of the active exercise apparatus 10 illustrated in FIG. 1 are given the same reference signs as those in FIG. 1, and detailed descriptions thereof will be omitted.

As illustrated in FIG. 6, an active exercise apparatus 11 of the embodiment is the same as the active exercise apparatus of the first embodiment described above except that one sole support plate 14 is supported by arms 3*a* and 3*b*. In the active exercise apparatus 11 of the embodiment as well, holding fixtures can be attached to the sole support plate 14. In that case, as in the first embodiment, two holding fixtures for the right and left legs may be attached, or a holding fixture into which the part for holding the right leg and the part for holding the left leg are integrated may be used instead. As a method of attaching the holding fixture, a method of attaching firmly by screws or the like is preferably used to avoid a problem of displacement of the holding fixture during use as in the first embodiment.

The active exercise apparatus of the first embodiment requires the user to move alternately the right and left legs, and is difficult to use for a patient with paralysis in one of the lower limbs, for example. In contrast, the active exercise apparatus 11 of the embodiment allows the user to move the right and left legs in cooperation while supporting the both right and left legs by the one sole support plate 14. This allows even the user with paralysis in one of the legs to perform active exercise of the lower limbs. As a result, the active exercise apparatus 11 is applicable to a wide variety of patients.

In the active exercise apparatus 11 of the embodiment, the integrated right and left sole support plate is provided to allow the user to move the right and left legs in cooperation. Accordingly, the sole support plate does not rotate around axes vertical to the surface of the base body. That is, in the active exercise apparatus 11 of the embodiment, the sole support plate 14 rotates around the shaft 2 and the axes $x_1$ and $x_2$ parallel to the surface of the base body. Accordingly, even with paralysis in one of the lower limbs, the patient can perform actively the dorsal flexion and plantar flexion of the ankle joints.

The active exercise apparatus 11 of the embodiment allows the planar and dorsal flexions of the ankle joints without inversion or eversion. Accordingly, it can be expected that, when being applied to a stroke patient, the active exercise apparatus 11 of the embodiment is effective in preventing the deformation of the feet such as clubfoot. Further, in the active exercise apparatus 11 of the embodiment as well, the reaction force exertion members 7 such as springs are mounted on the sole support plate 14, and the user can contract more effectively the soleus muscles with high exercise efficiency. The configurations and effects of the embodiment other than the foregoing ones are the same as those of the first embodiment.

Third Embodiment

Figure 7:
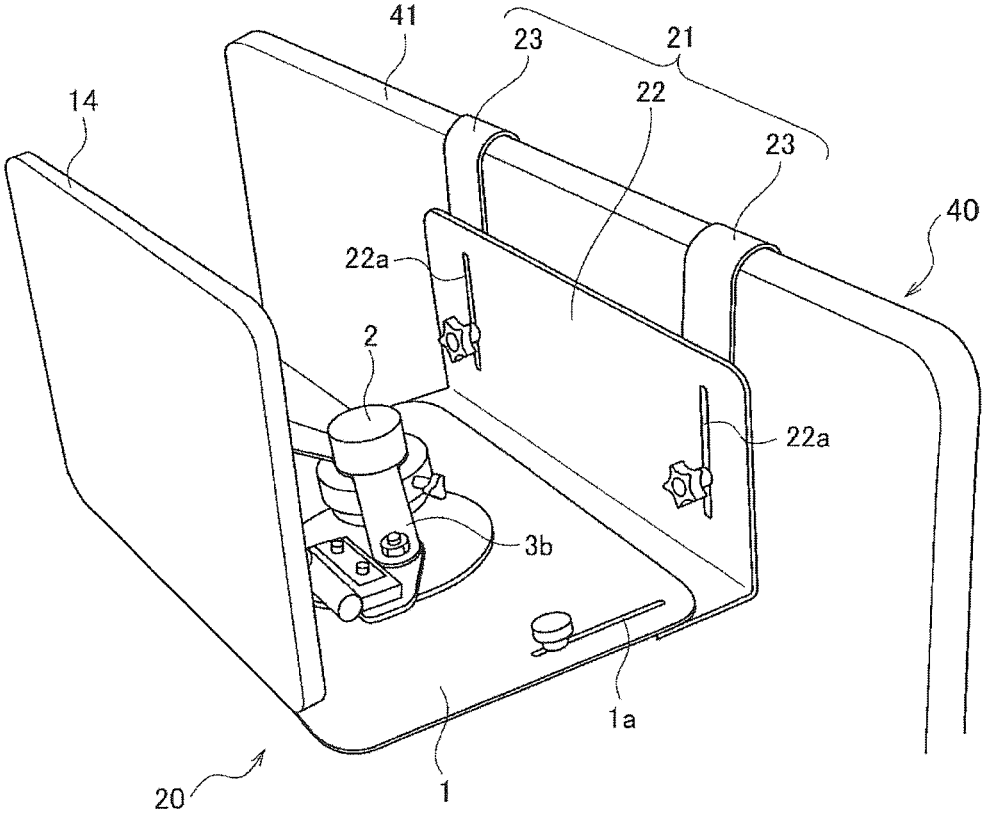
FIG. 7 is a schematic perspective view of a configuration of an active exercise apparatus according to a third embodiment of the present invention.

Next, an active exercise apparatus according to a third embodiment of the present invention will be described. FIG. 7 is a perspective view of a state in which an active exercise apparatus of the embodiment is installed on a bed. In FIG. 7, the same components as those of the active exercise apparatus 11 illustrated in FIG. 6 are given the same reference signs as those in FIG. 6, and detailed descriptions thereof will be omitted. As illustrated in FIG. 7, in an active exercise apparatus 20 of the embodiment, installation members 21 for installing a fence 41 of a bed 40 are attached to the base body 1.

[Installation Members 21]

The installation members 21 include a base member 22 that is L-shaped in a side view and hook members 23 for mounting on the fence 41 of the bed 40 as illustrated in FIG. 7, for example. As with the active exercise apparatus 20, the installation members 21 can be configured to be mounted on the fence 41 of the bed 40, thereby to facilitate work such as installation and removal, and improve stability as compared to the case where the installation members 21 are fixed by strings or belts.

The base member 22 of the installation members 21 can be provided with guide holes for adjusting the position of the base body 1 in the front-back direction and guide holes 22*a* for adjusting the position of the base body 1 in the height direction. In that case, the base body 1 can also be provided with guide holes 1*a* extending in the front-back direction at the corresponding positions so that the base body 1 can be slid with respect to the base member 22 to adjust the position of the base body 1 in the front-back direction of the base body 1.

Similarly, the hook members 23 can also be provided with guide holes extending in the vertical direction so that the base member 22 can be slid with respect to the hook members 23 to adjust the position of the base body 1 in the vertical direction. This makes it possible to adjust the position of the sole support plate 14 depending on the body shape of the user and the size of the bed, thereby allowing the user to perform active exercise at any time in the optimum position.

FIG. 7 illustrates the example in which the installation members are provided to the active exercise apparatus of the second embodiment illustrated in FIG. 6, but the present invention is not limited to this. The installation members are also applicable to the active exercise apparatus of the first embodiment illustrated in FIG. 1 to obtain the same advantageous effect. The configurations and effects of the embodiment other than the foregoing ones are the same as those of the first and second embodiments.

Modification Example of the Third Embodiment

Figure 8:
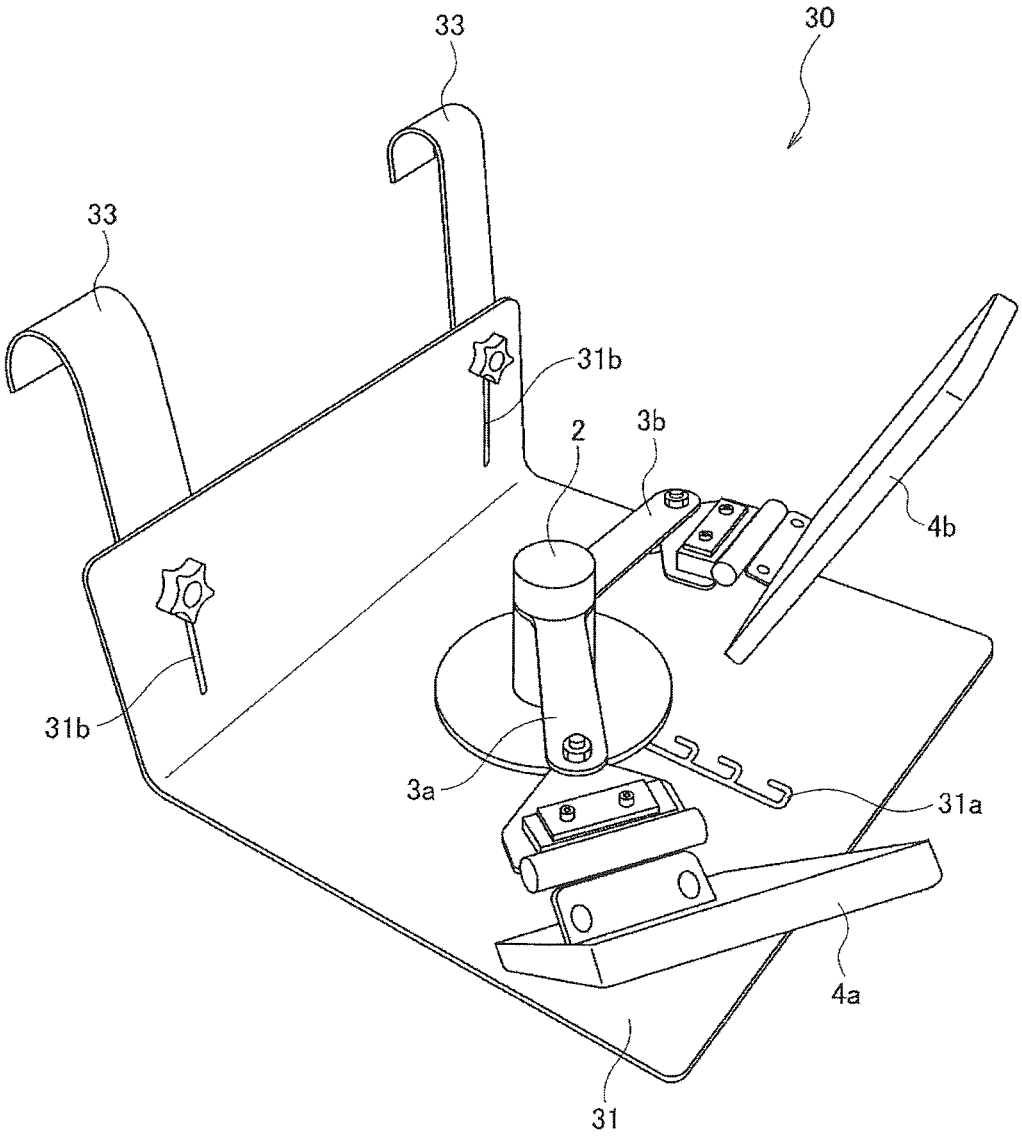
FIG. 8 is a schematic perspective view of a configuration of an active exercise apparatus according to a modification example of the third embodiment of the present invention.

Next, an active exercise apparatus according to a modification example of the third embodiment of the present invention will be described. In the third embodiment described above, the installation members 21 including the base member 22 L-shaped in a side view is attached to the flat plate-like base body 1 as an example. However, the present invention is not limited to this but the base member and the base body may be formed integrally. FIG. 8 is a perspective view of a configuration of an active exercise apparatus according to the modification example. As illustrated in FIG. 8, in an active exercise apparatus 30 of the modification example, hook members 33 are attached to a base body 31 that is L-shaped in a side view.

[Base Body 31]

The base body 31 may have a guide hole 31*a* in the bottom surface to adjust the position of the shaft 2 in the front-back direction. In addition, the base body 31 may have guide holes 31*b* in a wall surface to which the hook members 33 are attached to adjust the position of the base body 31 in the vertical (height) direction. The guide hole 31*a* may be linear in shape or may be configured such that lateral holes are formed in a linear hole at regular intervals, for example.

Meanwhile, for example, the guide holes 31*b* are linear holes extending in the vertical direction. The hook members 33 can also be provided with guide holes extending in the vertical direction to slide the base body 31 with respect to the hook members 33 and adjust the position of the base body 31 in the vertical direction. FIG. 8 illustrates an example in which the guide hole 31*a* extending in the front-back direction is formed to move the shaft 2 in the direction toward the user or in the direction distant from the user. However, the present invention is not limited to this configuration. The guide hole of an arbitrary shape can be formed in the direction in which the shaft 2 is to be moved.

In the active exercise apparatus of the modification example, one of the installation members is integrated with the base body to decrease the parts count and improve handling property. In addition, by providing guide holes to the base body of the modification example as well, it is possible to adjust easily the position of the sole support plates depending on the body shape of the user and the size of the bed. The configurations and effects of the modification example other than the ones described above are the same as those of the third embodiment.

REFERENCE SIGNS LIST

1 and 31 Base body
1*a*, 22*a*, 31*a*, and 31*b* Guide hole
2 Shaft
3*a* and 3*b* Arm
4*a*, 4*b*, and 14 Sole support plate
5*a* and 5*b* Holding fixture
6 Stage
7 Reaction force exertion member
10, 11, 20, and 30 Active exercise apparatus
15 Plantar venous plexus compression member
21 Installation member
22 Base member
23 and 33 Hook member
40 Bed
41 Fence

What is claimed is:

1. An active exercise apparatus for lower limbs, comprising:
- a base body;
- a shaft fixed to the base body having a first axis vertical to a surface of the base body;
- a pair of arms that are rotatably attached to the shaft, rotatable by the first axis of the shaft that is vertical to the surface of the base body, and each arm of the pair of arms is extended in a direction at an equal angle with respect to the first axis of the shaft;
- a sole support plate rotatably attached to a leading end of each of the arms and rotatable by a second axis parallel to the surface of the base body and by a third axis vertical to the surface of the base body; and
- a reaction force exertion member installed on a back surface of each sole support plate to exert a reaction force on backward rotation by the second axis parallel to the surface of the base body.

2. The active exercise apparatus for lower limbs according to claim 1, wherein holding fixtures for holding a user's feet are attached to the sole support plate.

3. The active exercise apparatus for lower limbs according to claim 2, wherein the holding fixtures include plantar venous plexus compression members.

4. The active exercise apparatus for lower limbs according to claim 1, wherein the sole support plate is disposed above the base body.

5. The active exercise apparatus for lower limbs according to claim 1, further comprising a stage, which is mountain-shaped such that there is a peak between two ends, the stage being inclined downward from a center in a front-back direction and is configured such that the center is configured to be positioned on backs of a user's knees to hold the user's lower limbs with the knees in flexion.

6. The active exercise apparatus for lower limbs according to claim 1, further comprising hook members for mounting on a fence of a bed.

7. The active exercise apparatus for lower limbs according to claim 1, comprising guide holes to adjust the positions of the sole support plate in the front-back direction and a vertical direction.

8. The active exercise apparatus for lower limbs according to claim 1, wherein the active exercise apparatus is configured to allow active exercise by a user selected from the group consisting of ankle joints' dorsal flexion, plantar flexion, plantar inversion, and plantar eversion.

9. An active exercise apparatus for lower limbs, comprising:
- a base body;
- a shaft fixed to the base body having a first axis vertical to a surface of the base body;
- a pair of arms that are rotatably attached to the shaft, rotatable by the first axis of the shaft that is vertical to the surface of the base body, and each arm of the pair of arms is extended in a direction at an equal angle with respect to the first axis of the shaft;
- a sole support plate rotatably attached to a leading end of both of the pair of arms and rotatable by a second axis parallel to the surface of the base body and by a third axis vertical to the surface of the base body; and
- a reaction force exertion member installed on a back surface of the sole support plate to exert a reaction force on backward rotation by the second axis parallel to the surface of the base body.

10. The active exercise apparatus for lower limbs according to claim 9, wherein holding fixtures for holding a user's feet are attached to the sole support plate.

11. The active exercise apparatus for lower limbs according to claim 10, wherein the holding fixtures include plantar venous plexus compression members.

12. The active exercise apparatus for lower limbs according to claim 9, wherein the sole support plate is disposed above the base body.

13. The active exercise apparatus for lower limbs according to claim 9, further comprising a stage, which is mountain-shaped such that there is a peak between two ends, the stage being inclined downward from a center in a front-back direction and is configured such that the center is configured to be positioned on backs of a user's knees to hold the user's lower limbs with the knees in flexion.

14. The active exercise apparatus for lower limbs according to claim 9, further comprising hook members for mounting on a fence of a bed.

15. The active exercise apparatus for lower limbs according to claim 9, comprising guide holes to adjust the positions of the sole support plate in the front-back direction and a vertical direction.

16. The active exercise apparatus for lower limbs according to claim 9, wherein the active exercise apparatus is configured to allow active exercise by a user selected from the group consisting of ankle joints' dorsal flexion, plantar flexion, plantar inversion, and plantar eversion.

* * * * *